US005142510A

United States Patent [19]

Rodda

[11] Patent Number: 5,142,510

[45] Date of Patent: Aug. 25, 1992

[54] ACOUSTIC TRANSDUCER AND METHOD OF MAKING THE SAME

[75] Inventor: William E. Rodda, Trenton, N.J.

[73] Assignee: David Sarnoff Research Center, Inc., Princeton, N.J.

[21] Appl. No.: 723,656

[22] Filed: Jun. 26, 1991

Related U.S. Application Data

[63] Continuation of Ser. No. 579,516, Sep. 10, 1990, abandoned.

[30] Foreign Application Priority Data

Jan. 3, 1990 [GB] United Kingdom ..... 9000100

[51] Int. Cl.[5] ..... H04R 17/00

[52] U.S. Cl. ..... 367/163; 367/174; 310/800; 310/324; 381/190; 29/25.35

[58] Field of Search ..... 367/157, 163, 174; 310/800, 331, 324; 381/173, 190; 29/594, 25.35

[56] References Cited

U.S. PATENT DOCUMENTS

| | | | |
|---|---|---|---|
| 3,973,150 | 8/1976 | Tamura et al. | 381/190 |
| 4,295,010 | 10/1981 | Murphy | 381/190 |
| 4,469,920 | 9/1984 | Murphy | 318/190 |
| 4,517,665 | 5/1985 | DeReggi et al. | 367/163 |

*Primary Examiner*—J. W. Eldred
*Attorney, Agent, or Firm*—William J. Burke

[57] ABSTRACT

An acoustic transducer which can be made small in size, i.e., in width, length and thickness, so as to fit into a credit card size package. The transducer comprises a flat frame having an opening therethrough. A pair of diaphragms of a piezoelectric plastic material extend across the opening in the frame along opposite sides of the frame. The diaphragms are stretched in at least one direction and are bonded to the frame under tension in the direction of the stretch. The diaphragms are bonded together at a position within the opening in the frame. The diaphragms are coated in both surfaces with conductive metal films. The inner metal films on the diaphragms which are opposed to each other are electrically connected together and the outer metal films are electrically connected together.

8 Claims, 3 Drawing Sheets

ACOUSTIC TRANSDUCER AND METHOD OF MAKING THE SAME

FIELD OF THE INVENTION

This is a continuation of application 07/579,516, filed Sept. 10, 1990, now abandoned.

The present invention relates to an acoustic transducer and method of making the same. More particularly, the present invention relates to a thin piezoelectric film acoustic transducer and method of making the same.

BACKGROUND OF THE INVENTION

For many new developments it has been found desirable to have electronic circuit packages not only small in area, but also very thin. For example, electronic circuits are being built into plastic credit cards which have area dimensions of about 2.12 by 3.37 inches and a thickness of about 0.04 inches. In addition, there has been found a need for a credit card size electronic circuit which includes an acoustic transducer for providing a sound to be sent over a telephone. Such acoustic transducers must not only be small and thin, but must also be capable of providing sound pressure levels of about 20 dynes per square centimeter for a minimum of −9 dBm electrical signal at telephone set line terminals.

Although there are miniature dynamic loudspeakers that use a moving coil and magnet structure, they are more than five times the thickness of a credit card. Thin piezoelectric ceramic diaphragm transducers are available in thickness of 0.02 inches. However, the ceramic material is brittle and subject to fracture in the event that the credit card is bent or sat upon. Electrostatic loudspeakers can be made in thin form. However, they require relatively large drive voltage amplitudes that are impractical with the limited battery power available in a credit card size circuit.

Piezoelectric plastic films, such as polarized polyvinylidene fluoride, has been used as the diaphragm and transducer element of an acoustic transducer. Such piezoelectric plastic film exhibits a transverse piezoelectric effect; i.e., when an electric field is applied perpendicularly to the film, a strain occurs in the plane of the film. Since a flat diaphragm of a piezoelectric plastic film cannot efficiently generate motion perpendicularly to the film diaphragm, cylindrical or spherical shaped films have been employed to translate transverse motion into linear motion normal to the film. Such dome-shaped thin films are generally achieved by applying back pressure with a compliant plastic foam material to maintain the shape. However, the foam introduces damping and stiffness to the motion of the film diaphragm and thereby serves to limit acoustic output. To overcome this problem there has been developed a design in which two circular, flat diaphragms are mounted with their peripheries clamped in spaced relation and the centers of the films being secured together so that each film is in the form of a cone. This design is shown in the U.S. patents of Preston V. Murphy, U.S. Pat. No. 4,295,010, issued Oct. 13, 1981 entitled PLURAL PIEZOELECTRIC POLYMER FILM ACOUSTIC TRANSDUCER, and U.S. Pat. No. 4,469,920, issued Sept. 4, 1984, entitled PIEZOELECTRIC FILM DEVICE FOR CONVERSION BETWEEN DIGITAL ELECTRIC SIGNALS AND ANALOG ACOUSTIC SIGNALS. However, it has been found that this design has a problem in that the thin film tends to wrinkle which results in low acoustic output and distortion.

SUMMARY OF THE INVENTION

The present invention relates to an acoustic transducer comprising a pair of diaphragms of films of a piezoelectric material which have been stressed in at least one direction. The edges of the diaphragms are clamped in spaced relation with the diaphragms been placed in tension in the direction that the films are stretched. The films are bonded together at a position between the edges along the direction of the stretch. The acoustic transducer is made by clamping one diaphragm under tension in the direction of its stretch. Placing the other diaphragm over the one film and clamping the other film under tension in the direction of its stretch. At least one of the diaphragms is then moved toward the other at a point between its clamped edges until the diaphragms contact each other. The diaphragms are bonded together at the bond of contact.

Figure 1:
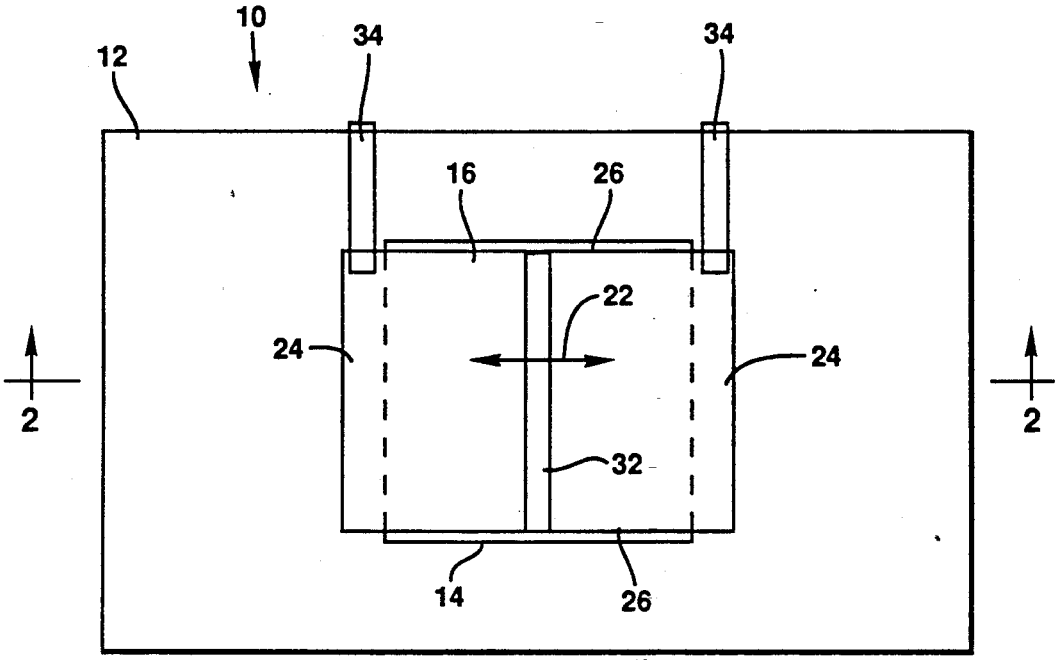
FIG. 1 is a top plan view of one form of the acoustic transducer of the present invention.

It should be noted that the Figures of the Drawing are not necessarily drawn to scale.

DETAILED DESCRIPTION

Figure 2:
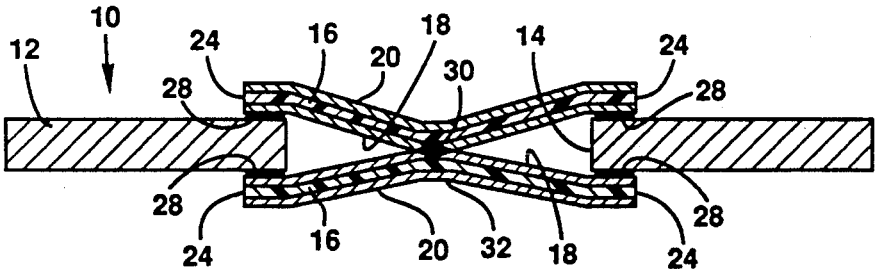
FIG. 2 is a sectional view taken along line 2—2 of FIG. 1.

Referring initially to FIGS. 1 and 2, there is shown one form, generally designated as 10, of the acoustic transducer of the present invention. The acoustic transducer 10 comprises a thin, flat frame 12 having a rectangular opening 14 therethrough. Although the frame 12 is shown as being of a conductive material, such as a metal, is may be made of an electrical insulating material, such as a plastic. For use in a credit card type package, the frame 12 is preferably about 3.375 inches by 2.125 inches and of a thickness of about 0.025 inches. The opening 14 is about 1 inch by 1 inch. Secured across the opening 14 along each side of the frame 12 is a separate diaphragm 16 of a thin layer of a piezoelectric plastic material, such as polarized polyvinylidene fluoride. Each of the diaphragms 16 is coated on each of its surfaces with a thin layer 18 and 20 of a conductive metal, such as copper or nickle. Each of the diaphragms 16 is of a length slightly longer than the opening 14, about 1.2 inches, and slightly narrower than the opening 14, about 0.97 inch. As part of the polarizing process for the diaphragms 16, the plastic layer is stretched in at least one direction. The diaphragms 16 are stretched in the direction of their length as indicated by the double headed arrow 22 in FIG. 1.

Each diaphragm 16 is mounted across the opening 14 in the frame 12 with its ends 24 overlapping and bonded to a surface of the frame 12 along opposed edges of the opening 14 and with its side edges 26 being spaced slightly from the other pair of opposed edges of the opening 14. Prior to bonding the ends 24 of the diaphragms 16 to the frame 12, the diaphragms 16 are placed under tension in the direction of the stretch. Thus, the diaphragms 16 are under tension when completely secured to the frame 12. The ends 24 of the diaphragms 16 are bonded to the frame 12 using a suitable cement 28. As shown in FIG. 2, the diaphragms 16 extend toward each other and contact each other between the ends 24 of the diaphragms 16. The diaphragms 16 are bonded to each other, with a suitable cement 30, along a line 32 which extends substantially parallel to the ends 24 of the diaphragms 16 and perpendicular to the line of stretch. Thus, the diaphragms 16 are V-shaped with the apices being bonded together and with the ends being clamped to the frame 12.

Figure 3:
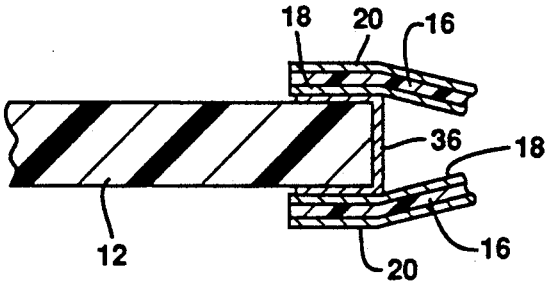
FIG. 3 is a sectional view of a portion of a modification of the form of the acoustic transducer shown in FIGS. 1 and 2.

The metal films 18 and 20 on the diaphragms 16 are electrically connected together, with the metal films 18 on the inner surfaces of the diaphragms 16, i.e., the metal films facing each other through the opening 14, being connected together, and the metal films 20 on the outer surfaces being connected together. If, as shown in FIGS. 1 and 2, the frame 12 is of a metal, the inner metal films 18 may be connected together directly through the frame 12 using a conductive cement 28. The outer metal films 20 may be connected together by a conductor 34 extending between the outer metal films 20 and around an edge of the frame 12 as shown in FIG. 1. The conductor 34 should be insulated from the frame 12. The inner metal films may also be connected together by using a conductive cement 30 for bonding the diaphragms 16 together along the line 32. If, as shown in FIG. 3, the frame 12 is of an insulating material, the inner metal films 18 may be connected together by a metal layer 36 extending between the ends 24 of the diaphragms 16 across the edges of the opening 14 as well as by a conductive cement 30 bonding the diaphragms 16 together along the line 32. The outer metal films 20 may be connected together by a metal film, not shown, extending across the outer surfaces and an outer edge of the frame 12 similar to the conductor 34 in FIG. 1.

In the operation of the acoustic transducer 10, each diaphragm 16 is connected across a source of voltage so that each metal film 18 is of one polarity and the other metal film 20 is of the opposite polarity. This causes the piezoelectric material of the diaphragm 16 to expand and contract laterally of the surface of the diaphragm 16. However, since the diaphragm 16 has an angled portion, the lateral movement has a component of motion perpendicular to the frame 12 so that the diaphragms 16 move in the direction perpendicular to the frame 12. Thus, sound waves are developed by the movement of the diaphragms. By placing the diaphragms 16 under tension in the direction of the stretch of the diaphragms 16, prevents wrinkling of the diaphragms 16 in the direction of the expansion and contraction of the diaphragms. This maximizes the acoustic output of the transducer 10 so that it will produce the desired acoustic output even in the very small size. Transducers 10 of the present invention of the size described above have produced in the 700 Hz to 1500 Hz dual tone multi-frequency (dtmf) range a sound pressure level of about 20 dynes/cm$^2$ in an acoustic cavity of 20 cubic centimeters. This is sufficient to produce acoustic tones at a level to operate a touch tone telephone by placing the acoustic transducer against the telephone receiver and producing the appropriate tone levels.

Figure 4:
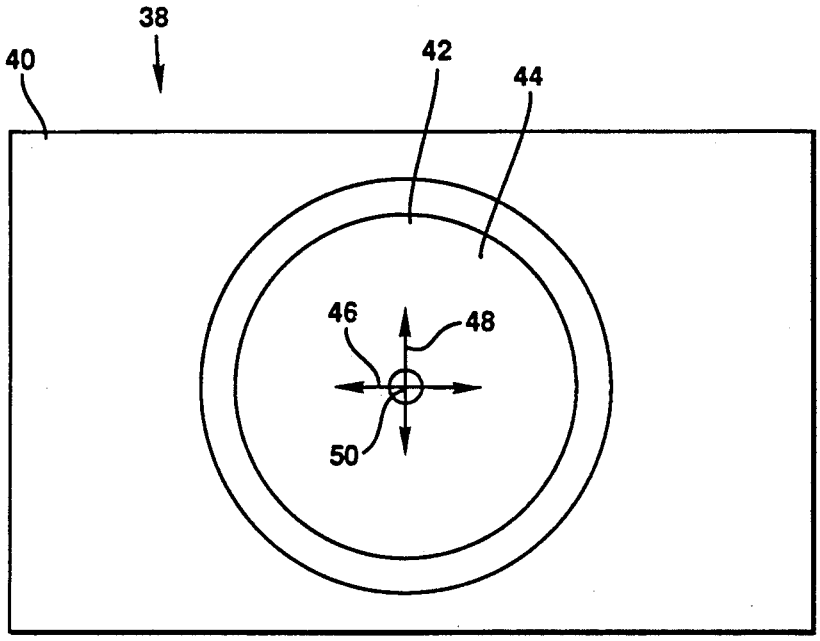
FIG. 4 is a top plan view of another form of the acoustic transducer of the present invention.

Referring to FIG. 4, a modification of the acoustic transducer of the present invention is generally designated as 38. Acoustic transducer 38, like the acoustic transducer 10 shown in FIGS. 1 and 2, comprises a frame 40 having an opening 42 therethrough. A pair of diaphragms 44 of a piezoelectric plastic coated on both sides with a metal film extend across the opening 42 along both surfaces of the frame 40. The diaphragms 44 extend over and are bonded to the surfaces of the frame 40 around the periphery of the opening 42. However, in the acoustic transducer 38, the opening 42 in the frame 40 is circular, and the diaphragms 44 are also circular and are bonded to the frame 40 completely around the peripheries thereof. Also, each of the diaphragms are stretched in two directions perpendicular to each other as indicated by the double headed arrows 46 and 48. The diaphragms 44 are bonded to each other at a point 50 at the center of the diaphragms so that each of the diaphragms 44 is in the form of a cone. As in the acoustic transducer 10, the metal films on the inner surfaces of the diaphragms 44 are electrically connected together and the metal films on the outer surfaces of the diaphragms 44 are electrically connected together. Each of the diaphragms 44 is under tension in both directions of its stretch so as to remove any wrinkles from the diaphragms 44.

The acoustic transducer 38 operates in the same manner as the acoustic transducer 10 described above. Since the diaphragms are under tension in both of the directions of stretch so as to remove any wrinkles, the acoustic output of the transducer 38 is increased. Although the acoustic transducer 38 of the present invention with the round diaphragms 44 operates satisfactorily, the acoustic transducer 10 with the rectangular diaphragms 16 is preferred. The acoustic transducer 10 with the rectangular diaphragms 16 can be made easier and less expensively than the acoustic transducer 38 with the round diaphragms 42. The square diaphragms 16 are made from uniaxially stretched material whereas the round diaphragms 42 are made from more expensive biaxially stretched material. Also, the square diaphragms 16 can be formed from a strip of the material without any waste whereas the round diaphragms 42 must be cut from a strip of material leaving some waste. In addition, the volume displacement of the round diaphragm 42 is $\frac{2}{3}$ that of a rectangular transducer 16. Thus, the rectangular transducer 16 can produce about 3 dB more sound pressure than the round diaphragm 42.

Figure 5:
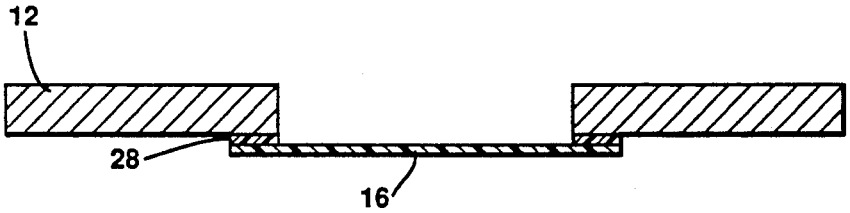
FIGS. 5–7 are schematic views illustrating the steps of making the acoustic transducer of the present invention.
Figure 6:
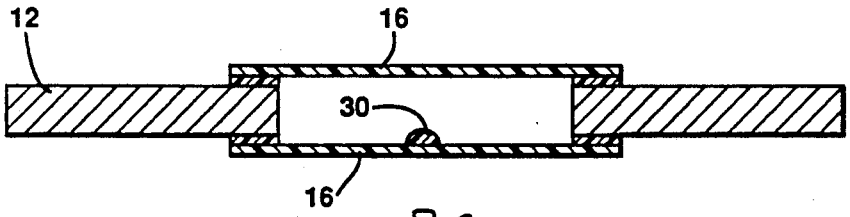
Figure 7:
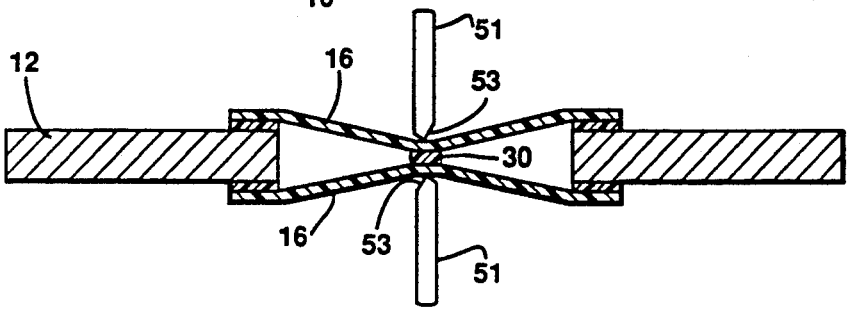

Referring to FIGS. 5–7 there is illustrated the steps of a method of making the acoustic transducer 10 of the present invention. A diaphragm 16 is first placed across the opening 14 in the frame 12 along one side of the frame and bonded to the frame 12 by suitable cement 28. The diaphragm 16 may be taken from a roll of the piezoelectric plastic material, placed under tension, pressed against the cement 28 to bond it to the frame 12, and then cut to size. Some cement 30 is then placed on the inner surface of the diaphragm along the line 32 which is parallel to the ends of the diaphragm 16. As shown in FIG. 6, a second diaphragm 16 is then placed over the opening 14 along the other side of the frame 12 and secured to the frame 12 by a cement 28. The second diaphragm 16 like the first may be taken from a roll of the piezoelectric material. As shown in FIG. 7, anvils 51 having pointed ends 53 are then moved against the diaphragms 16 from opposite sides of the frame 12 along the line 32 to move the diaphragms 16 together until they contact at the cement 30. While two anvils 51 are shown, a single anvil 51 can be used to move one of the diaphragms 16 against the other while supporting the other diaphragm 16 against a support. The appropriate electrical connections between the metal films on the diaphragms 16 can then be formed.

Figure 8:
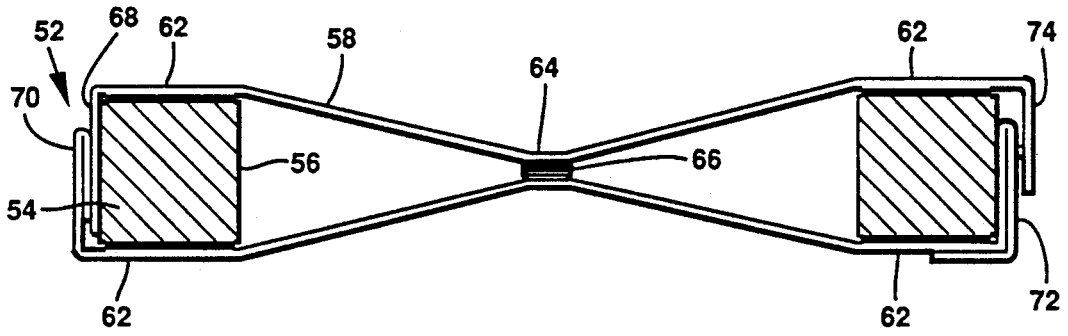
FIG. 8 is a sectional view of still another form of the acoustic transducer of the present invention.

Referring to FIG. 8, there is shown another modification 52 of the acoustic transducer of the present invention. The acoustic transducer 52 comprises a frame 54 in the form of a thin, enclosed square having an inner square opening 56. The square opening 56 is about 1 inch by 1 inch and the width of the body of the frame 54 is about 0.1 inch. A pair of rectangular diaphragms 58 and 60 extend across the opening 56 in the frame 54 along opposite sides of the frame 54. Each of the diaphragms 58 and 60 is of a uniaxially stretch piezoelectric plastic coated on both sides with a metal film. The diaphragms 58 and 60 are under tension in the direction of their stretch and are bonded to the frame 54 with a suitable cement 62. The diaphragms 58 and 60 are longer than the entire width of the frame 54 so that the ends of the diaphragms 58 and 60 project beyond opposed sides of the frame 54. The diaphragms 58 and 60 are bonded together along a line 64 between and parallel to the ends of the diaphragms by a suitable cement 66.

One end 68 of the diaphragm 58 is bent across the outer edge of its adjacent end of the frame 54. The adjacent end 70 of the diaphragm 60 is folded inwardly upon itself and is pressed against the end 68 of the diaphragm 58. Thus, the outer metal films of the two diaphragms 58 and 60 are in electrical contact with each other. They may be bonded in this relation with a suitable electrically conductive cement, not shown. The other end 72 of the diaphragm 60 is bent across the outer edge of its adjacent end of the frame 54 and folded outwardly against itself. The other end 74 of the diaphragm 58 is bent over the folded end 72 of the diaphragm 60. Thus, the inner metal films of the two diaphragms 58 and 60 are in electrical contact with each other. They may be bonded in this relation with a suitable electrically conductive cement, not shown.

The acoustic transducer 52 operates in the same manner as the acoustic transducer 10 previously described. The acoustic transducer 52 has the advantage that the metal films on the diaphragms 58 and 60 are connected directly to each other without the need of any additional connecting means. However, it has the disadvantage that it is more time consuming to make in that it requires the folding of the ends of the diaphragms.

Thus, there is provided by the present invention an acoustic transducer which can be made small in size, i.e. length, width and thickness, so that it can be placed in a credit card size package. However, the acoustic transducer is capable of providing an acoustic output which is large enough to operate a telephone. In addition, the acoustic transducer of the present invention is simple and easy to assemble and can be assembled on an assembly line basis.

What is claimed is:

1. An acoustic transducer comprising:

a flat frame having an opening therethrough;

a pair of rectangular diaphragms of thin films of a piezoelectric plastic which are uniaxially stretched between two opposed ends thereof, means securing only said opposed edges of the diaphragms in spaced relation to said frame and placing said diaphragms under tension in the direction that the film is stretched; and means bonding the diaphragms together at a position between the said edges along a line substantially parallel to said edges of the diaphragms and perpendicular to the direction of the stretch.

2. An acoustic transducer in accordance with claim 1 wherein each of the diaphragms has a thin film of a conductive material on each side thereof.

3. An acoustic transducer in accordance with claim 1 in which the opening in the frame is square, each of the diaphragms is longer than the opening so that the ends of the diaphragms extend beyond a pair of opposed edges of the opening and are bonded to a surface of the frame, and the width of each of the diaphragms is less than the width of the opening so that there is a space between the sides of the diaphragms and the other opposed edges of the opening.

4. An acoustic transducer in accordance with claim 3 in which each of the diaphragms has a metal film on each of its surfaces, the metal films on the inners surface of the diaphragms which are opposed to each other are electrically connected together and the metal films on the outer surfaces of the diaphragms are electrically connected together.

5. An acoustic transducer in accordance with claim 4 in which the ends of one of the diaphragms are bent across the outer edges of the frame and the ends of the other diaphragm are folded and seated against the ends of the one diaphragm so that one end of the other diaphragm has its inner metal film in contact with the inner metal film of the one diaphragm and the other end of the other diaphragm has its outer metal film in contact with the outer metal film of the one diaphragm.

6. A method of making an acoustic transducer comprising the steps of:

placing a first rectangular diaphragm of a piezoelectric plastic material which is uniaxially stretched in the direction between opposed edges of the diaphragm over an opening in a substantially flat frame along one side of the frame;

bonding only the said opposed edges of the first diaphragm to the frame with the diaphragm being under tension in the direction of the stretch;

placing bonding cement on the surface of the first diaphragm along a line between and parallel to said opposed edges and substantially perpendicular to the direction of the stretch;

placing a second rectangular diaphragm of a piezoelectric plastic material which is uniaxially stretched in the direction between opposed edges of the second diaphragm over said opening in the frame and along the other side of the frame;

bonding only the said opposed edges of the second diaphragm to the frame with the opposed edges of the second diaphragm being over and spaced from the said opposed edges of the first diaphragm and with the second diaphragm being under tension in the direction of the stretch;

bringing the two diaphragms into contact with each other along said line of bonding cement at a position within the opening in the frame; and bonding the two diaphragms together at the position of contact.

7. The method of claim 6 in which the two diaphragms are bonded together along said line by moving at least one of the diaphragms toward the other along said line until they contact along the line of the cement.

8. The method of claim 6 in which each of the diaphragms is coated on each side thereof with a film of a metal, and the inner metal film on the diaphragms facing each other through the opening in the frame are electrically connected together and the outer metal films on the two diaphragms are electrically connected together.

* * * * *